United States Patent [19]

Cross

[11] 4,299,643

[45] Nov. 10, 1981

[54] METHOD OF MAKING A HINGED DISPLAY MOUNT

[76] Inventor: Carroll N. Cross, Rte. 2, Box 741, Maitland, Fla. 32751

[21] Appl. No.: 176,265

[22] Filed: Aug. 8, 1980

[51] Int. Cl.[3] ..... B31F 23/10; G09F 3/18; G09D 3/04; B21D 5/14

[52] U.S. Cl. ..... 156/223; 40/13; 40/119; 72/179; 248/463

[58] Field of Search ..... 156/221, 223, 582; 248/463, 459; 40/13, 119; 29/11; 72/179, 180; 220/334, 339, 341

[56] References Cited

U.S. PATENT DOCUMENTS

| | | | |
|---|---|---|---|
| 1,852,881 | 4/1932 | Gray | 40/119 |
| 3,002,720 | 10/1961 | Cross | 248/463 |
| 3,184,942 | 5/1965 | Cookson | 72/179 |
| 3,339,875 | 9/1967 | Gerald | 248/463 |

*Primary Examiner*—Edward C. Kimlin
*Assistant Examiner*—Louis Falasco
*Attorney, Agent, or Firm*—William M. Hobby, III

[57] ABSTRACT

A hinged display mount hinged with a thin aluminum strip is formed in a manner to prevent damage to the display mount upon bending of the hinge. The aluminum hinge is secured to a pair of panels and preformed or shaped with a die in a manner to produce a clean bend after the panels and hinge have been casebound.

7 Claims, 9 Drawing Figures

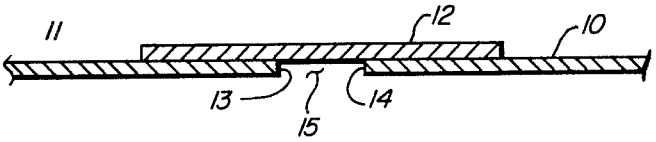
FIG. 1
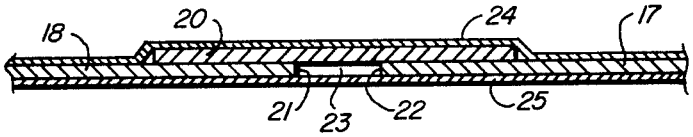
FIG. 2
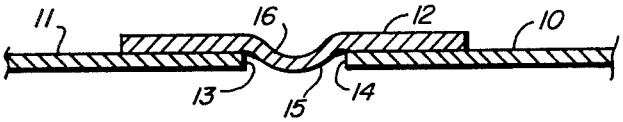
FIG. 3
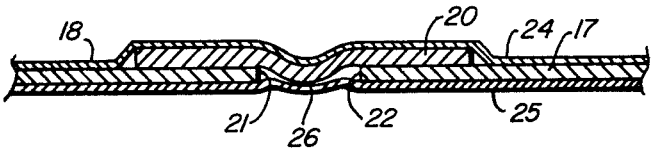
FIG. 4
FIG. 5
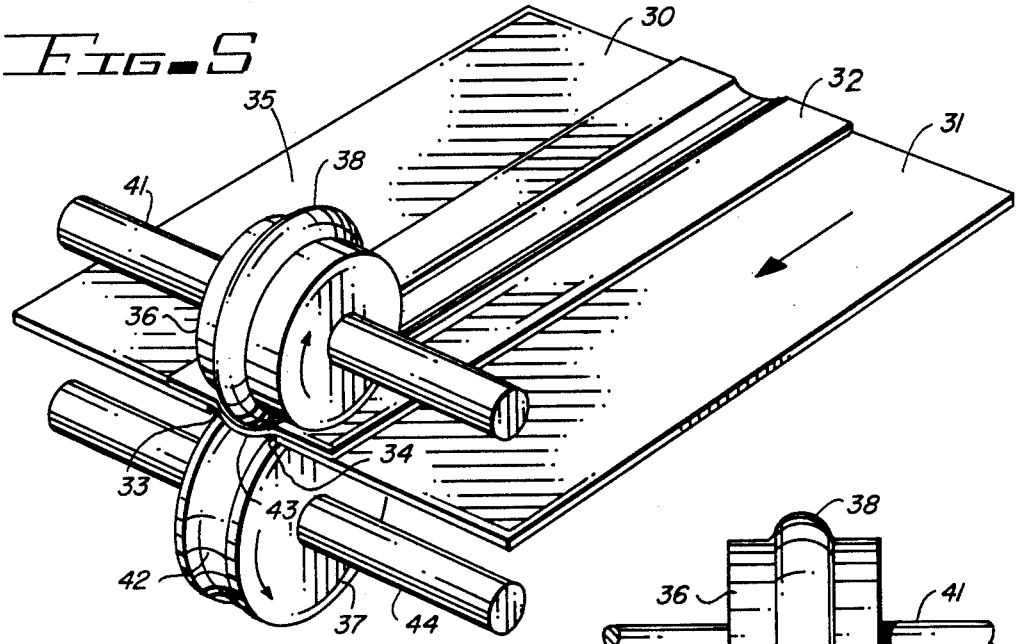
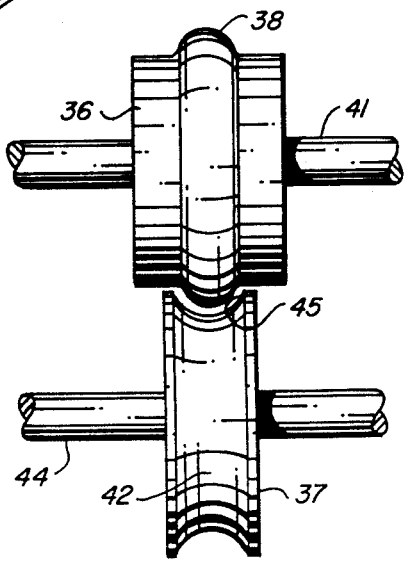
FIG. 6

METHOD OF MAKING A HINGED DISPLAY MOUNT

BACKGROUND OF THE INVENTION

The present invention deals with the method of making a hinged display mount of the type having a thin ductile hinge holding display panels in a predetermined position relative to each other and especially to a method which preforms the hinge in a manner to overcome damage to the binding when folding the panels on the hinge.

In my prior U.S. Pat. No. 3,002,720, a display mount is shown attaching panels together with a thin strip of aluminum so that the panels once casebound can be folded into position without having additional supports for the mounts. The metal hinged items have been stored and shipped in a flat position at the factory and from the factory to customers. The use of the aluminum hinge has been successfully produced and marketed and is still successfully used in the industry. In the use of aluminum hinged display mounts I have noticed that it is sometimes difficult to determine the exact location of the hinge since the casebound display is shipped in a flat position and the user has difficulty in determining where to exert pressure for folding the display at the right place. In addition, occasional breakage of the binding or lining material on the outside of the aluminum hinge has been noticed on occasion which reduces the aesthetic appearance of the display mount. An outward pressure is applied to the casebinding when two boards connected by a metal strip are folded from a flat position into face-to-face relationship. The paper or leatherette binding lining over the relatively flat surface of the board and connecting metal strip will sometimes break with the outward pressure as a result of rotating the hinged boards to a right angle or in a face-to-face relation to each other. This breakage problem has been especially noticeable under certain temperatures and humidity conditions, such as in very hot, dry areas. Heavier kraft base paper leatherette has not solved the problem particularly when the items are stored in cold temperatures and shipped during cold weather. When any glue adheres to the metal and binding, the problem is worsened as is the case when manufactured during dry periods with minimum of humidity and heat.

The present invention provides a method of making a display mount having a thin metal strip or aluminum hinge preshaped to prevent the breakage of the lining when the hinge is used and which also identifies the position that the panels are to be folded by the ultimate user receiving the shipped display mount in the flat shipping position.

SUMMARY OF THE INVENTION

A method of making a hinged display mount provides the steps of securing a ductile strip of material, such as a thin strip of aluminum, along parallel edges of a pair of panels to form a pair of hinged panels and in the same operation or thereafter shaping the ductile strip of material secured to the panels with a die of predetermined shape. This shaping of the ductile hinge by die can be before or after casebinding the panels, so that the hinged area can be identified by the user and the panel can be bent on the hinged area without damage to the casebinding material. A two part roller die of predetermined shape having a convex arcuate cross section can work with a female roller die having a concave arcuate cross section. The method also encompasses the positioning of a pair of display mount panels in a face-to-face relationship separated by a spacing member and having one edge of each panel aligned parallel with one edge of the other panel, then capping and securing a thin strip of ductile material, such as a thin strip of aluminum, over the aligned parallel edges of the panels to hinge the panels together. The spacing member can then be removed, the panels opened and casebound.

BRIEF DESCRIPTION OF THE DRAWINGS

Other objects, features and advantages of the present invention will be apparent from the written description and the drawings in which:

FIG. 1 is a sectional view of a hinge attached to a pair of panels:

FIG. 2 is an elevational view of a hinge strip attaching a pair of panels and being casebound thereover;

FIG. 3 is an elevational view of the hinged panels of FIG. 1 having a hinged area shaped in accordance with the present invention;

FIG. 4 is an elevational view of the hinged panels of FIG. 2 being shaped in accordance with the present invention;

FIG. 5 is a perspective view of roller dies shaping hinged panels in accordance with the present method;

FIG. 6 is a front elevation of the dies of FIG. 5;

DESCRIPTION OF THE PREFERRED EMBODIMENTS

Figure 7:
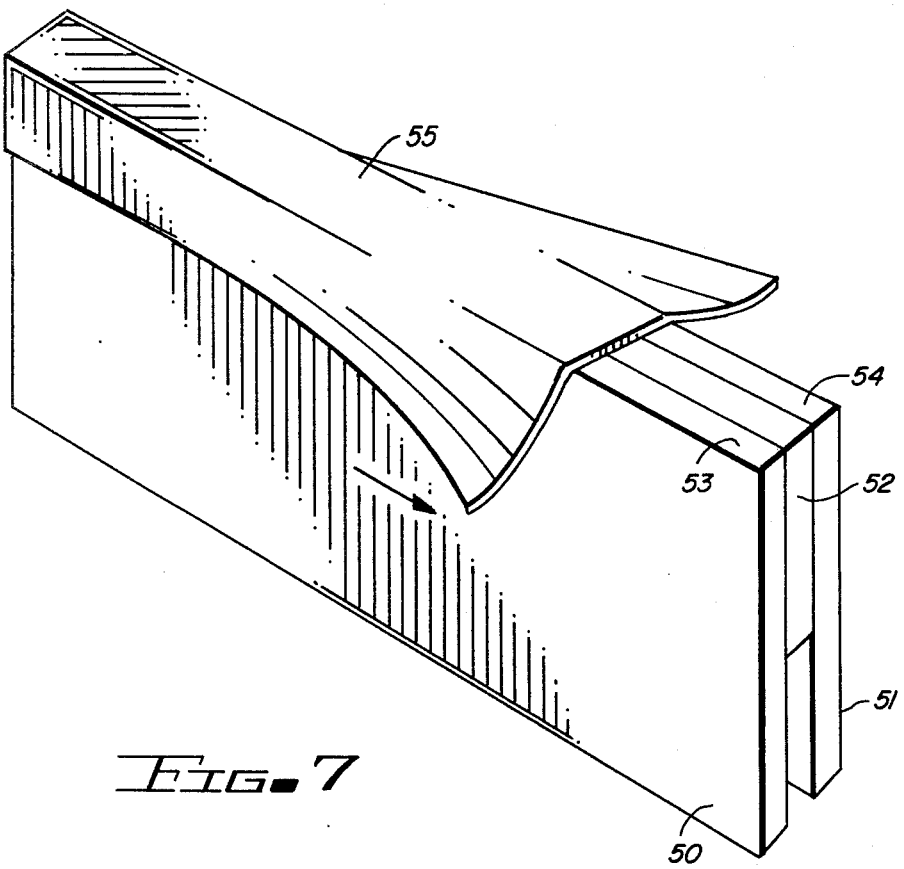
FIG. 7 is a perspective view of an alternate embodiment for hinging panels together.

Referring to FIGS. 1 through 6 of the drawings, a method is illustrated for forming display mounts having two paperboard panels 10 and 11. In FIGS. 1 and 2 a thin strip of ductile material, such as a thin strip of aluminum 12, is secured along parallel edges 13 and 14 of panels 11 and 10, respectively. A space 15 is provided between the panels 10 and 11. Once the panels have been attached as shown in FIG. 1, the aluminum hinge 12 in FIG. 2 is preformed with a cross sectional shape 16 as shown in Figure which may be formed with roller dies as illustrated in FIGS. 5 and 6. The display panels in FIG. 2 would then be casebound on one or both sides covering the aluminum hinge 12 having the preshaped area 16 therein. Alternatively, in FIGS. 3 and 4, a pair of panels 17 and 18 can be attached with hinge 20, which may be a thin strip of ductile material, such as aluminum, securing the panels 17 and 18 along parallel edges 21 and 22 leaving a space 23 therebetween. A casebinding material 24, such as lining paper or a leatherette binding, can be secured over the hinged area and a second casebinding material 25 can be secured to the opposite side of the panels 17 and 18. The hinged together panels 17 and 18 with the hinge 20 can at the same in line operation or subsequently have the hinged area shaped in a predetermined manner 26 with the dies in FIGS. 5 and 6 also shaping the ginding material 24 and 25 in the operation. The aluminum strip 20 is debossed or formed within the space 23 between the edges 21 and 22 of the panels 18 and 17. In FIG. 5, a pair of panels 30 and 31 have an aluminum hinge 32 secured thereto along spaced parallel edges 33 of panel 30, and 34 of panel 31 and are fed through the debossing or shaping die 35 having a male die section 36 and a female die section 37. The male die section has an annular die portion 38 having a generally arcuate convex cross section wrapped around a cylindrical die portion 36 mounted to a roller guide rod 41. Pressure is applied to the aluminum hinged area 32 against female die portion 37, which has an annular die portion 42 with an arcuate concave cross section matching the die portion 38. Die portion 37 has a generally disc or cylindrical shape with the die portion 42 on the annular edge portion thereof riding in the spacing 43 between the edges 33 and 34 to coact with the die 36 on the other side of the aluminum hinge 32 to shape the metal hinge 32 between the inner edges of the board. Die portion 37 has a roller guide rod 44 and one or the other roller guide rods 41 or 44 is adjustable relative to the other to adjust the spacing 45 as more clearly shown in FIG. 6. The method according to the present invention provides for attaching a pair of panels with a thin ductile strip, such as a thin strip of aluminum, and preforming the hinged area secured to the panels either before or after casebinding the panels and aluminum hinge using debossing dies, such as illustrated in FIGS. 5 and 6.

Figure 8:
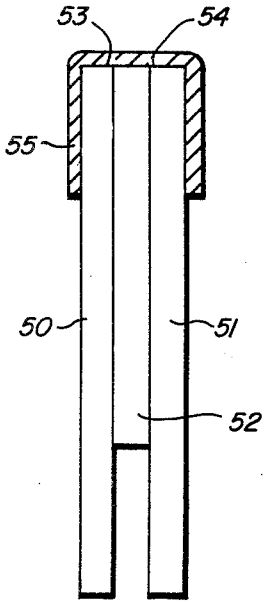
FIG. 8 is a sectional view of the hinged panels in accordance with FIG. 7.
Figure 9:
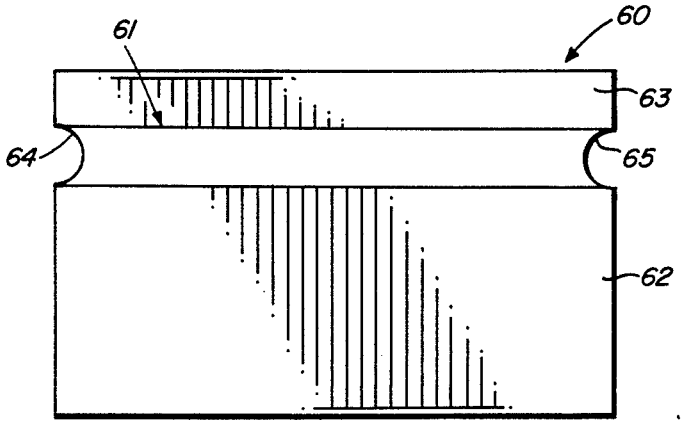
FIG. 9 is a side elevation of a display mount in accordance with the present invention.

FIGS. 7 and 8 illustrate an alternate embodiment in which a pair of panels 50 and 51 are positioned in a face-to-face relationship separated by a spacing member of board 52 and positioned with their edges 53 and 54 parallel to each other. A thin strip of aluminum or other ductile material 55 is capped and secured over the edges 53 and 54 to the panels 50 and 51 as shown in the cross section in FIG. 8. The spacer board 52 can then be removed and the attached panels 50 and 51 flattened out and casebound. The opening or flattening of the panels produces a preformed shape to the aluminum hinge 55 which identified the hinge in the flattened out panel which has been casebound and also avoids the breaking of the binding material when the panel is again folded to position the display mount. FIG. 9 shows a display mount 60 having a preformed metal hinge 61 connecting panels 62 and 63. When binding around the edges of one or more panels the leatherette extends over the outside and also the opposite side at both ends of the hinge so there is greater tension when angularly disposed against the leatherette. To help solve this extra outward pressure the cardboard panels and metal may be die-cut and removed at each of the ends of the hinge in a circular or three-sided cut. When the metal hinge 61 and board panels 62 and 63 are die-cut, the side toward the platen has sharp edges, particularly if the die is not sharp. These sharp protruding edges are a factor in the "cutting" and weakening of the leatherette when on the outside of bound panel(s), thus causing cutting and breakage. When the smooth side of the metal and boards is placed against the glued side of the binding so when hinge is folded with obtuse angle on the leatherette bound side less breakage tendency results.

It should be clear at this point that a method of making a hinged display mount has been provided which advantageously avoids problems long existing in the art of not being able to identify the hinged area and having the casebinding or lining material damaged by the improper folding or under adverse temperature and humidity conditions. However, the present method is not to be considered as limited to the steps shown, which are to be considered illustrative rather than restrictive.

I claim:

1. A method of making a casebound hinged display mount comprising the steps of:

securing a thin ductile material along inwardly disposed substantially parallel edges of a pair of panels to form a pair of hinged panels; and shaping the ductile strip of material secured to said pair of panels between the parallel edges of said pair of panels to produce a predetermined bend parallel to one said inwardly disposed parallel edge of the panel, said shaping of said thin ductile strip of material including passing the ductile strip of material attached to the pair of panels between a pair of spaced coacting dies, one die having a convex cross-section and the other die having a concave cross-section, whereby said hinged area can be identified for subsequent folding of said hinged panels along said hinge between said parallel edges of said hinged panels.

2. The method in accordance with claim 1, wherein the pair of spaced coacting dies includes a roller die rolling against the thin ductile strip of material.

3. A method in accordance with claim 1, including the step of casebinding the hinged panels secured with a thin ductile strip of material following the step of shaping the ductile strip of material.

4. A method in accordance with claim 1, including the step of casebinding the pair of panels secured by a thin ductile strip of material prior to shaping the ductile strip of material securing the pair of panels through the casebinding.

5. The method in accordance with claim 1, in which the step of securing a thin ductile strip of material to a pair of panels includes securing a thin strip of aluminum to a pair of panels and in the same operation shaping the strip of aluminum secured thereto.

6. The method in accordance with either of claim 3 or 4, including the step of die-cutting each end of the thin strip of material secured to a pair of panels to remove a portion of material therefrom.

7. The method in accordance with claim 6, in which the step of die-cutting each end of the strip of material includes die-cutting an arcuate piece of material from each end thereof.

* * * * *